US007137386B1

(12) United States Patent
Ruiz

(10) Patent No.: US 7,137,386 B1
(45) Date of Patent: Nov. 21, 2006

(54) CLOSED LOOP A/F RATIO CONTROL FOR DIESEL ENGINES USING AN OXYGEN SENSOR

(75) Inventor: Victoriano Ruiz, Brighton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/219,412

(22) Filed: Sep. 2, 2005

(51) Int. Cl.
*F02D 41/14* (2006.01)
*F02D 41/00* (2006.01)

(52) U.S. Cl. ..... 123/674

(58) Field of Classification Search ..... 123/674, 123/486, 703, 672, 478, 480
See application file for complete search history.

(56) References Cited

U.S. PATENT DOCUMENTS

| | | | | |
|---|---|---|---|---|
| 4,955,345 | A * | 9/1990 | Brown et al. | 123/381 |
| 5,094,214 | A * | 3/1992 | Kotzan | 123/479 |
| 5,558,064 | A * | 9/1996 | Buslepp | 123/480 |
| 6,701,905 | B1 * | 3/2004 | Gaskins | 123/674 |

* cited by examiner

*Primary Examiner*—Mahmoud Gimie
(74) *Attorney, Agent, or Firm*—Christopher DeVries

(57) ABSTRACT

A fuel control system for a diesel engine includes a first module that calculates a block learn multiplier (BLM) based on a feedback signal during a closed-loop fuel control period. A second module adjusts a base fueling rate of the diesel engine based on the BLM during an open-loop fuel control period.

18 Claims, 3 Drawing Sheets

CLOSED LOOP A/F RATIO CONTROL FOR DIESEL ENGINES USING AN OXYGEN SENSOR

FIELD OF THE INVENTION

The present invention relates to diesel engines, and more particularly to closed loop control of an air/fuel (A/F) ratio of a diesel engine using an oxygen sensor.

BACKGROUND OF THE INVENTION

Diesel engines generate drive torque by drawing in and compressing air. Fuel is injected into the compressed air and the heat of compression induces auto-ignition of the air/fuel mixture. As a result, diesel engines do not include spark plugs to induce ignition of the air/fuel mixture. The air to fuel (A/F) ratio is regulated using open-loop control (i.e., no feedback). Combustion of the air/fuel mixture drives pistons within cylinders. In turn, the pistons drive a crankshaft that transfers drive torque to a drivetrain.

The torque output of a diesel engine is regulated based on a fueling rate and injection timing. The fueling rate and injection timing for a particular diesel engine is developed on an engine dynamometer. More specifically, dynamometer data is used to develop look-up tables for fueling rate and injection timing based on engine speed (RPM) and engine load. The look-up tables are programmed into the memory of the control module of each diesel engine.

Because the look-up tables are developed from dynamometer data for a particular diesel engine type, they are not calibrated or otherwise adjusted for each particular diesel engine. As a result, accuracy in the A/F ratio control is dependent on the extent that engine components and operation thereof (e.g., injector flow, mass air flow meter, engine volumetric efficiency) deviate from the diesel engine system used on the dynamometer.

SUMMARY OF THE INVENTION

Accordingly, the present invention provides a fuel control system for a diesel engine. The fuel control system includes a first module that calculates a block learn multiplier (BLM) based on a feedback signal during a closed-loop fuel control period. A second module adjusts a base fueling rate of the diesel engine based on the BLM during an open-loop fuel control period.

In one feature, the base fueling rate is determined from a look-up table based on an engine speed (RPM) and an engine load.

In another feature, the base fueling rate is adjusted based on a ratio between the BLM and a neutral BLM value.

In still another feature, the fuel control system further includes an oxygen sensor that generates an oxygen sensor signal (OSS) based on an oxygen content of exhaust from the diesel engine. The feedback signal is the OSS.

In yet other features, the second module determines the base fueling rate from a look-up table and determines an adjusted fueling rate based on the BLM and the base fueling rate. The BLM is extrapolated across engine operating ranges of the look-up table to provide a plurality of BLMs. The fueling rate is adjusted based on one of the plurality of BLMs.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
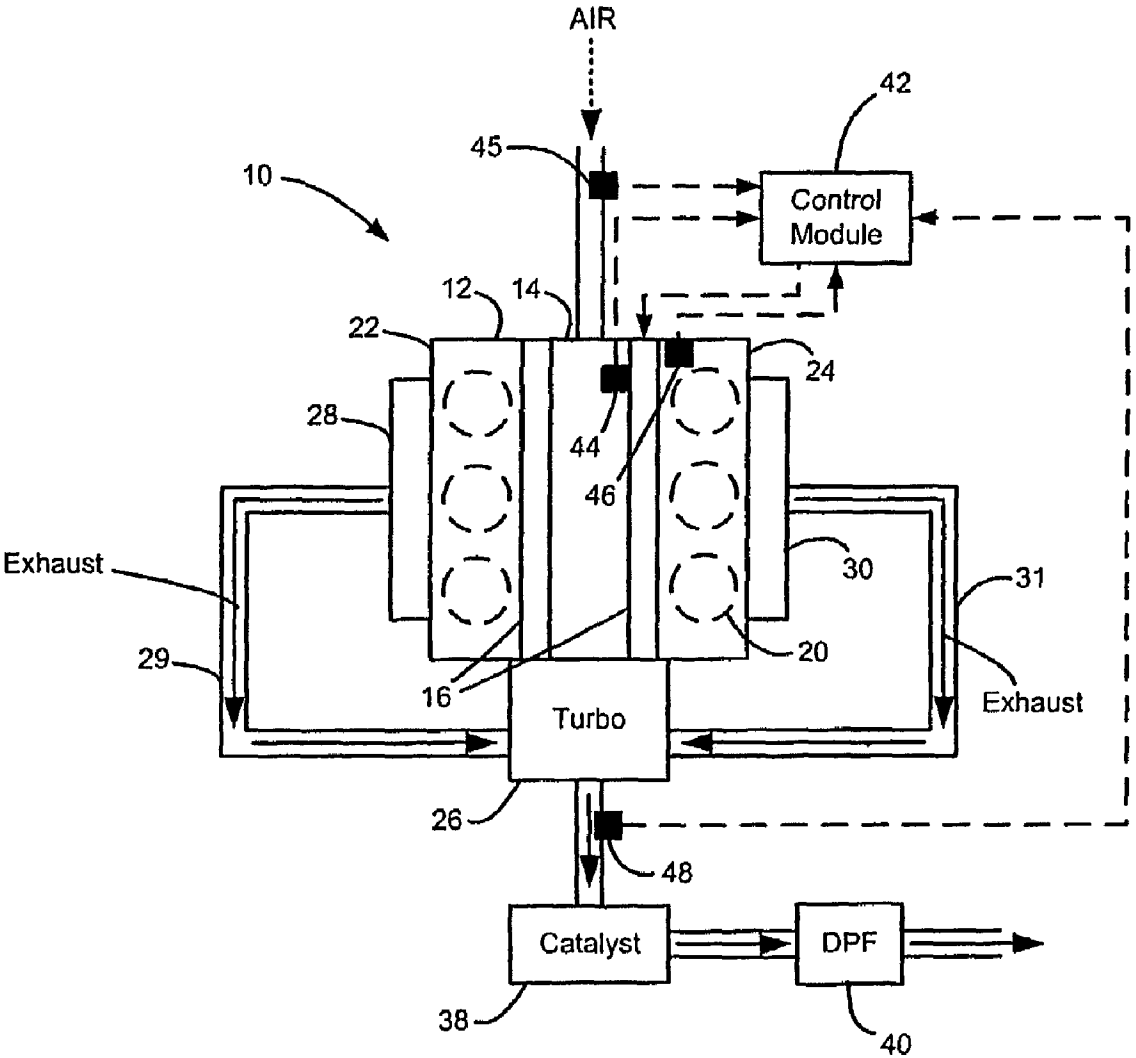
FIG. 1 is a functional block diagram of a diesel engine system that is regulated based on an adjustable fuel control in accordance with the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1 an exemplary diesel engine system 10 is schematically illustrated. It is appreciated that the diesel engine system 10 is merely exemplary in nature and that the adjustable fuel control described herein can be implemented in various diesel engine systems. The diesel engine system 10 includes a diesel engine 12, an intake manifold 14, a common rail fuel injection system 16 and an exhaust system 18. The exemplary engine 12 includes six cylinders 20 configured in adjacent cylinder banks 22,24 in V-type layout. Although FIG. 1 depicts six cylinders (N=6), it can be appreciated that the engine 12 may include additional or fewer cylinders 20. For example, engines having 2, 4, 5, 8, 10, 12 and 16 cylinders are contemplated.

Air is drawn into the intake manifold 14, is distributed to the cylinders 20 and is compressed therein. Fuel is injected into the cylinders 20 by the common rail injection system 16 and the heat of the compressed air ignites the air/fuel mixture. The exhaust gases are exhausted from the cylinders 20 and into the exhaust system 18. In some instances, the diesel engine system 10 can include a turbo 26 that pumps additional air into the cylinders 20 for combustion with the fuel and air drawn in from the intake manifold 14.

The exhaust system 18 includes exhaust manifolds 28,30, exhaust conduits 29,31, a catalyst 38 and a diesel particulate filter (DPF) 40. First and second exhaust segments are defined by the first and second cylinder banks 22,24. The exhaust manifolds 28,30 direct the exhaust segments from the corresponding cylinder banks 22,24 into the exhaust conduits 29,31. The exhaust is directed into the turbo 22 to drive the turbo 22. A combined exhaust stream flows from the turbo 22 through the catalyst 38 and the DPF 40. The DPF 40 filters particulates from the combined exhaust stream as it flows to the atmosphere.

A control module 42 regulates operation of the diesel engine system 10 according to the adjustable fuel control of the present invention. More particularly, the control module 42 communicates with an intake manifold absolute pressure (MAP) sensor 44, a mass air flow (MAF) sensor 45 and an engine speed sensor 46. The MAP sensor 44 generates a signal indicating the air pressure within the intake manifold 14, the MAF sensor 45 generates a MAF signal based on air flow into the engine 12 and the engine speed sensor 46 generates a signal indicating engine speed (RPM). An oxygen sensor 48 generates an oxygen sensor signal (OSS) based on an oxygen content of the exhaust. The oxygen sensor 48 is preferably a conventional switching oxygen sensor. The control module 42 determines a fueling rate based on RPM, engine load and a block-learn multiplier (BLM) discussed in further detail below. The fueling rate is generally measured in fuel volume per combustion event and the engine torque output is controlled via the fueling rate.

During normal operation, the control module 42 regulates engine fueling using an open-loop control. More specifically, the control module 42 determines a fueling rate from a pre-defined look-up table stored in memory. The fueling rate is determined based on RPM and engine load, which is determined based on MAP and/or MAF. The fueling rate is adjusted based on the BLM, as discussed in further detail below, and the injection system 16 is regulated to provide the desired fueling rate. During open-loop control, the control module regulates engine operation without any feedback indicating that the actual fueling rate was equal to the desired fueling rate. Additionally, the engine can be regulated to run across a broad range of A/F ratios (e.g., 80/1 to 13/1).

The control module 42 periodically initiates a DPF regeneration process. Moe specifically, the DPF 40 becomes full and must be regenerated to remove the trapped diesel particulates. During regeneration, the diesel particulates are burned within the DPF 40 to enable the DPF 40 to continue its filtering function. An exemplary regeneration method includes injecting fuel into the exhaust stream after the main combustion event. The post-combustion injected fuel is combusted over the catalyst 38. The heat released during the fuel combustion in the catalyst 38 increases the exhaust temperature, which burns the trapped particulates in the DPF 40.

The adjustable fuel control of the present invention provides a long-term fuel trim value or BLM. The BLM is determined based on the OSS during closed-loop control of the diesel engine system 10. More specifically, the BLM is determined during periods where the A/F ratio is controlled to a known value that is detectable by the oxygen sensor 48 (e.g., approximately 14.4). For example, during a DPF regeneration process, the A/F ratio is within a detectable range. During this period, closed-loop control is used to regulate engine operation based on the OSS. The A/F ratio is monitored based on the OSS and the control module 42 regulates fueling to maintain the A/F ratio at a desired value (e.g., 14.4).

The BLM is an adjustment factor that is applied to the fueling look-up table. The BLM is initially at a neutral value (e.g., 128) and is adjusted up or down based on the OSS during closed-loop control. Over several periods of closed-loop control, the BLM settles at a value that provides a desired A/F ratio based on the fueling rate determined from the look-up table. During subsequent operation using open-loop control, the fueling rate is adjusted based on the BLM. More specifically, the fueling rate is adjusted based on the BLM relative to the neutral BLM. For example, if the BLM is equal to 140, the fueling rate is increased by 140/128 (e.g., approximately 14%). If the BLM is equal to 110, the fueling rate is decreased by 110/128 (e.g., approximately 9%). In this manner, the BLM adjusts the fueling rate from the pre-programmed values to account for engine variations.

The BLM is adjusted based on a short-term integrator value. During closed-loop control, the integrator value increases or decreases based on the OSS. The BLM tracks the integrator based on a delay. More specifically, if the integrator value varies outside of a predefined range (e.g., 0.95 to 1.05), the BLM is incremented or decremented. For example, if the integrator value is greater than 1.05, the BLM is incremented. If the BLM is less than 0.95, the BLM is decremented. When the integrator value returns to within the predefined range, the BLM remains at its most recent value.

It is further anticipated that the BLM can be extrapolated across the engine operating ranges of the look-up tables. In this manner, the BLM value is weighted across the engine operating ranges and varies for each cell or block of cells of the look-up table. The fueling rate is increased or decreased based on the particular BLM for that cell of block of cells. For example, if one cell or block of cells includes a BLM of 140, the fueling rate of that cell or the various fueling rates in the block of cells is/are increased by 140/128 (e.g., approximately 9%). Another cell or block of cells includes a BLM of 110. Therefore, the fueling rate of that cell or the various fueling rates in the block of cells is/are decreases by 110/128 (e.g., approximately 14%).

Figure 2:
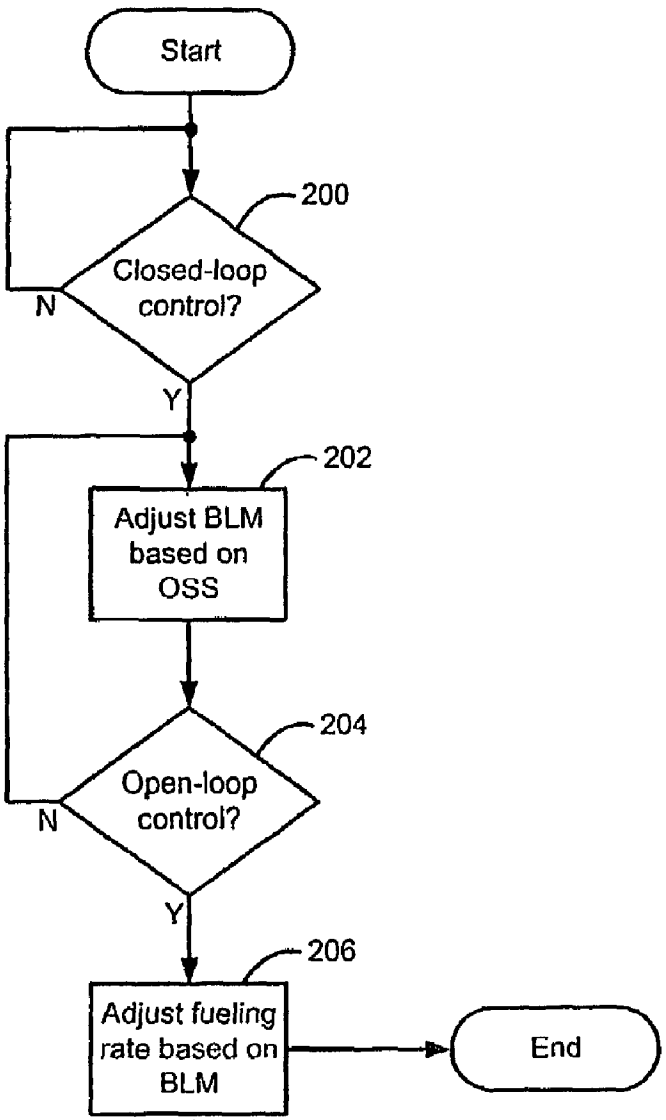
FIG. 2 is a flowchart illustrating exemplary steps executed by the adjustable fuel control of the present invention.

Referring now to FIG. 2, exemplary steps executed by the adjustable fuel control of the present invention will be described in detail. In step 200, control determines whether the engine is able to be operated using closed-loop control. For example, if a DPF regeneration process is to be performed, the engine can be regulated using closed-loop control. If closed-loop control is not available, control loops back. If closed-loop control is available, control continues in step 202.

In step 202, control adjusts the BLM based on the OSS, as described in detail above. In step 204, control determines whether open-loop control (i.e., normal diesel engine operation) is to be used. For example, if the DPF regeneration process has ended, control reverts back to open-loop. If open-loop control is not to be used, control loops back to step 202. If open-loop control is to be used, control adjusts the fueling rate based on the BLM during normal (i.e., open-loop) engine operation in step 206 and control ends.

Figure 3:
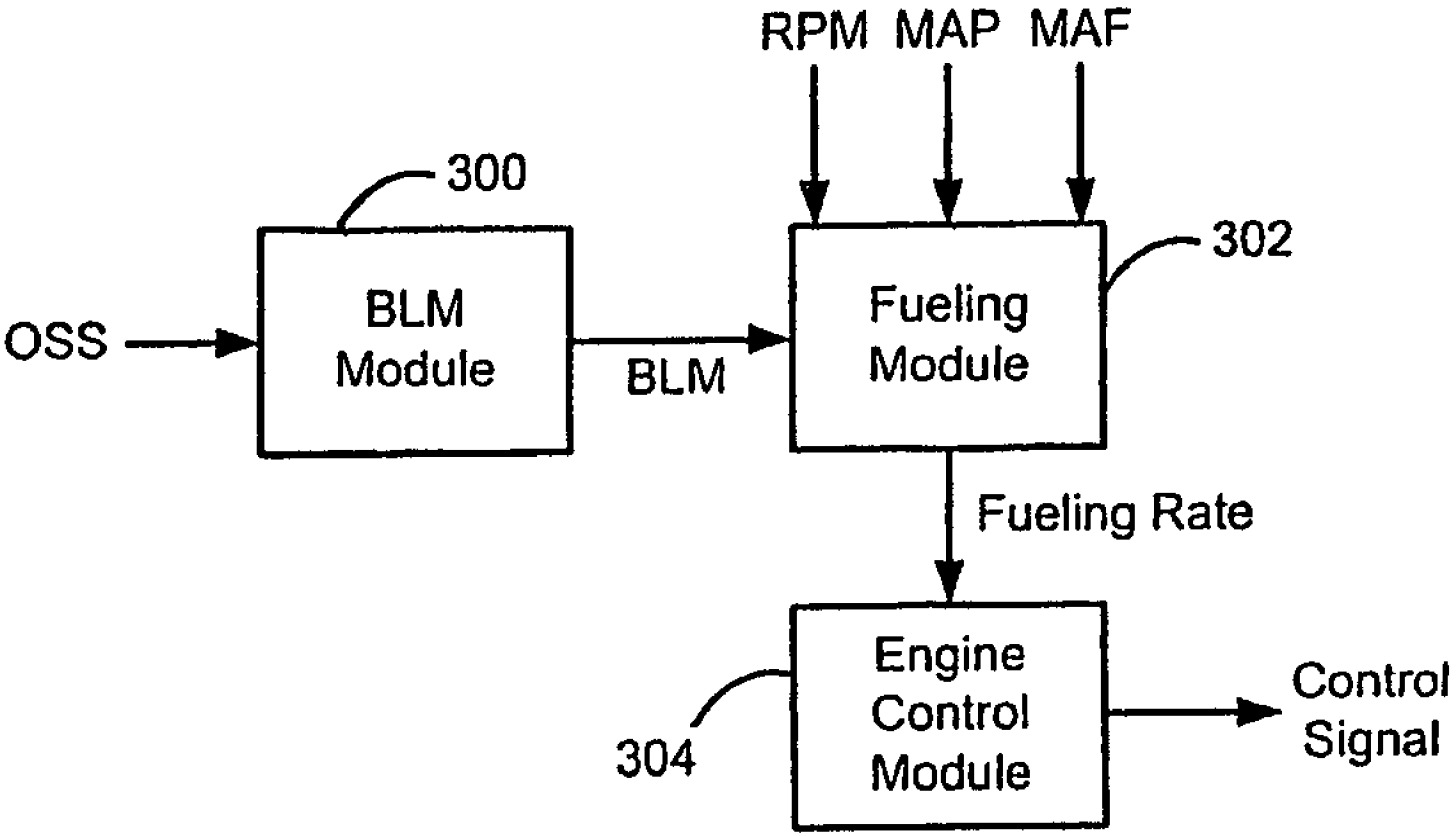
FIG. 3 is a functional block diagram of exemplary modules that execute the adjustable fuel control of the present invention.

Referring now to FIG. 3, exemplary modules that execute the adjustable fuel control of the present invention are illustrated. The exemplary modules include a BLM module 300, a fueling module 302 and an engine control module 304. The BLM module 300 calculates the BLM based on the OSS during closed-loop engine operation. The fueling module 302 determines a base fueling rate based on RPM and MAF and/or MAP. The fueling module 302 adjusts the base fueling rate based on the BLM. The engine control module 304 regulates engine operation based on the fueling rate.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fuel control system for a diesel engine, comprising:

a first module that selectively regulates operation of said diesel engine in one of a closed-loop air to fuel ratio (A/F) control mode and an open-loop A/F control mode;

a second module that calculates a block learn multiplier (BLM) based on a feedback signal when said first module operates said diesel engine in said closed-loop A/F control mode; and a third module that adjusts a base fueling rate of said diesel engine based on said BLM when said first module operates said diesel engine in said open-loop A/F control mode.

2. The fuel control system of claim 1 wherein said base fueling rate is determined from a look-up table based on an engine speed (RPM) and an engine load.

3. The fuel control system of claim 1 wherein said base fueling rate is adjusted based on a ratio between said BLM and a neutral BLM value.

4. The fuel control system of claim 1 further comprising an oxygen sensor that generates an oxygen sensor signal (OSS) based on an oxygen content of exhaust from said diesel engine, wherein said feedback signal is said OSS.

5. The fuel control system of claim 1 wherein said third module determines said base fueling rate from a look-up table and determines an adjusted fueling rate based on said BLM and said base fueling rate.

6. The fuel control system of claim 5 wherein said BLM is extrapolated across engine operating ranges of said look-up table to provide a plurality of BLMs, wherein said fueling rate is adjusted based on one of said plurality of BLMs.

7. A method of regulating fueling of a diesel engine, comprising:

selectively regulating operation of said diesel engine in one of a closed-loop air to fuel ratio (A/F) control mode and an open-loop A/F control mode;

calculating a block learn multiplier (BLM) based on a feedback signal during said closed-loop A/F control mode; and adjusting a base fueling rate of said diesel engine based on said BLM during said open-loop A/F control mode.

8. The method of claim 7 further comprising determining said base fueling rate from a look-up table based on an engine speed (RPM) and an engine load.

9. The method of claim 7 wherein said fueling rate is adjusted based on a ratio between said BLM and a neutral BLM value.

10. The method of claim 7 further comprising generating an oxygen sensor signal (OSS) based on an oxygen content of exhaust from said diesel engine, wherein said feedback signal is said OSS.

11. The method of claim 7 further comprising:

determining said base fueling rate from a look-up table; and calculating an adjusted fueling rate based on said BLM and said base fueling rate.

12. The method of claim 11 further comprising extrapolating said BLM across engine operating ranges of said look-up table to provide a plurality of BLMs, wherein said fueling rate is adjusted based on one of said plurality of BLMs.

13. A method of regulating fueling of a diesel engine during an open-loop air to fuel ratio (A/F) control mode, comprising:

initiating a closed-loop A/F control mode;

generating a feedback signal;

calculating a block learn multiplier (BLM) based on said feedback signal during said closed-loop A/F control mode;

initiating said open-loop A/F control mode; and adjusting a base fueling rate of said diesel engine based on said BLM during said open-loop A/F control mode.

14. The method of claim 13 further comprising determining said base fueling rate from a look-up table based on an engine speed (RPM) and an engine load.

15. The method of claim 13 wherein said fueling rate is adjusted based on a ratio between said BLM and a neutral BLM value.

16. The method of claim 13 further comprising generating an oxygen sensor signal (OSS) based on an oxygen content of exhaust from said diesel engine, wherein said feedback signal is said OSS.

17. The method of claim 13 further comprising:

determining said base fueling rate from a look-up table; and calculating an adjusted fueling rate based on said BLM and said base fueling rate.

18. The method of claim 17 further comprising extrapolating said BLM across engine operating ranges of said look-up table to provide a plurality of BLMs, wherein said fueling rate is adjusted based on one of said plurality of BLMs.

* * * * *